US009196396B2

(12) United States Patent
Li et al.

(10) Patent No.: US 9,196,396 B2
(45) Date of Patent: Nov. 24, 2015

(54) INSULATOR AND POWER TRANSMISSION LINE APPARATUS

(75) Inventors: Yan Li, Shenzhen (CN); Zhidong Jia, Shenzhen (CN); Yuming Zhao, Shenzhen (CN); Zhihai Xu, Shenzhen (CN); Xiaolin Li, Shenzhen (CN); Zhicheng Guan, Shenzhen (CN); Weiyan Liao, Shenzhen (CN); Xiaoxing Wei, Shenzhen (CN); Yu Tan, Shenzhen (CN); Yu Deng, Shenzhen (CN); Huafeng Su, Shenzhen (CN)

(73) Assignees: Graduate School at Shenzhen, Tsinghua University, Shenzhen (CN); Electric Power Research Institute, CSG, Guangzhou (CN)

( * ) Notice: Subject to any disclaimer, the term of this patent is extended or adjusted under 35 U.S.C. 154(b) by 47 days.

(21) Appl. No.: 13/980,197

(22) PCT Filed: Oct. 8, 2011

(86) PCT No.: PCT/CN2011/080552

§ 371 (c)(1),
(2), (4) Date: Jul. 17, 2013

(87) PCT Pub. No.: WO2013/049968

PCT Pub. Date: Apr. 11, 2013

(65) Prior Publication Data

US 2014/0069684 A1 Mar. 13, 2014

(51) Int. Cl.
*H01B 17/14* (2006.01)
*H01B 7/28* (2006.01)
(Continued)

(52) U.S. Cl.
CPC .. *H01B 7/28* (2013.01); *H01B 3/28* (2013.01); *H01B 9/008* (2013.01); *H01B 17/02* (2013.01); *H01B 17/50* (2013.01); *H01B 17/54* (2013.01)

(58) Field of Classification Search
CPC ..... H01B 17/50; H01B 17/42; H01B 17/40; H01B 17/02; H01B 17/46; H01B 17/08; H01B 17/32; H01B 19/04; H02G 15/072
USPC ..... 174/140 C, 143, 80, 137 R, 75 R, 182
See application file for complete search history.

(56) References Cited

U.S. PATENT DOCUMENTS 2,947,801 A * 8/1960 Doolittle ..... 174/141 R
3,192,312 A * 6/1965 Sauer ..... 174/209
(Continued)

FOREIGN PATENT DOCUMENTS

CN 1995251 7/2007
CN 101488383 7/2009
(Continued)

OTHER PUBLICATIONS

International Search Report, from Application PCT/CN2011/080552, dated Jul. 12, 2012, 6 pages.
(Continued)

*Primary Examiner* — Steven T Sawyer
(74) *Attorney, Agent, or Firm* — Hamre, Schumann, Mueller & Larson, P.C.

(57) ABSTRACT

An insulator is disclosed, which includes an insulating surface. A part of the insulating surface is applied with a conductive coating having a specific resistivity. A conductive coating region having the specific resistivity and a nonconductive coating region are configured that: in a dry environment, no continuous conductive channel exists between upper and lower fittings of the insulator. The value of the leakage current that can be caused by the conductive coating region having the specific resistivity on the insulating surface enables the insulating surface to reach an ice-proof temperature in an icing climate condition. Also, a power transmission apparatus in which the insulator is adopted is disclosed. In an icing climate condition, the conductive coating can achieve the function of increasing the value of the leakage current on the surface of the insulator, so as to prevent the ice formation.

8 Claims, 2 Drawing Sheets

(51) Int. Cl.

| | |
|---|---|
| ***H01B 17/02*** | (2006.01) |
| ***H01B 17/50*** | (2006.01) |
| ***H01B 3/28*** | (2006.01) |
| ***H01B 9/00*** | (2006.01) |
| *H01B 17/54* | (2006.01) |

(56) References Cited

U.S. PATENT DOCUMENTS

| | | | | |
|---|---|---|---|---|
| 3,836,705 | A * | 9/1974 | Rosenblatt | 174/140 C |
| 5,017,519 | A * | 5/1991 | Morimoto et al. | 501/7 |
| 5,493,072 | A * | 2/1996 | Stevens | 174/143 |
| 2013/0101846 | A1 * | 4/2013 | Hinrichsen et al. | 428/389 |

FOREIGN PATENT DOCUMENTS

| | | |
|---|---|---|
| CN | 201549283 | 8/2010 |
| CN | 102140310 | 8/2011 |

OTHER PUBLICATIONS

"The Icing Mechanism on Insulators and a New De-icing Method", Gang Chen, Science-Engineering(B), China Doctoral Dissertations Full-Text Database, Aug. 2011, No. 8, 119 pages.

* cited by examiner

INSULATOR AND POWER TRANSMISSION LINE APPARATUS

CROSS REFERENCE TO RELATED APPLICATIONS

This application is a national phase application of PCT/CN2011/080552, filed on Oct. 8, 2011. The contents of PCT/CN2011/080552 are all hereby incorporated by reference.

BACKGROUND

1. Technical Field

The present disclosure relates to the field of power transmission and transformation, and more particularly to an insulator and a power transmission line apparatus having the insulator.

2. Related Art

For a large amount of power transmission lines passing through a vast area, an ice layer is usually formed on the surface of the insulators and wires in a cold climate condition. The accidents such as line breakage, tower collapses and flashover trip-out might occur when the condition gets severe. A conventional insulator has surface materials such as room temperature vulcanized (RTV) silicone rubber and permanent RTV (PRTV) silicone rubber, which have good hydrophobicity at the room temperature. However, due to the characteristics of the materials, when the temperature approaches the zero degree, the hydrophobicity disappears and the material no longer has the ice-resistant capability. The ice-resisting method of generating heat through the power consumption to increase the surface temperature is the most effective ice-resistant measure at present, which has achieved a good effect in the ice-resistance of power transmission lines. However, in the application to the insulator, two problems to be solved are how to avoid influencing the insulating property of the insulator and how to control the loss. Currently, no effective measures are provided for eliminating or preventing the icing of the insulator, and the flashover accident of the insulator caused by the icing occurs now and then, such that the safe and stable operation of the electric power system is influenced.

SUMMARY

For the defects in the prior art, the present disclosure provides an insulator and a power transmission line apparatus having the insulator, such that during normal operation, the leakage current of the insulator is same as that of a conventional insulator, and in an icing climate condition, the value of the leakage current increases to increase the surface temperature of the insulator, thereby preventing the icing, while the power consumption is controlled at a relatively low level.

To achieve the above objective, the present disclosure adopts the following technical solution:

An insulator includes an insulating surface. A part of the insulating surface is applied with a conductive coating having a specific resistivity. A conductive coating region having the specific resistivity and a nonconductive coating region are configured such that in a dry environment, no continuous conductive channel exists between fittings at end portions of the insulator, and the insulating surface reaches an ice- resisting temperature in an icing climate condition due to a leakage current on the insulating surface caused by the conductive coating having the specific resistivity.

Preferably, the insulator is a disk-shaped suspension-type insulator, and a position of applying the conductive coating is selected within regions other than regions adjacent to an upper fitting of the insulator.

Preferably, the conductive coating is applied at a lower surface of the insulator.

Preferably, a volume resistivity of the conductive coating is between $10^3$ ohm-centimeters and $10^5$ ohm-centimeters.

Preferably, a coating thickness of the conductive coating is between 0.2 mm and 0.6 mm, and in particular between 0.3 mm and 0.4 mm.

Preferably, a main material of the conductive coating is conductive silicone rubber.

Preferably, the silicone rubber is added with carbon black, and in particular 10%-30% carbon black by weight.

Preferably, the nonconductive coating region is applied with RTV silicone rubber or PRTV silicone rubber.

Preferably, the insulator is a ceramic suspension-type insulator or a glass suspension-type insulator.

A power transmission line apparatus includes at least one of the above insulator, and preferably includes an insulator string formed of a plurality of the insulators connected to a power transmission line.

In the present disclosure, a conductive coating having a specific resistivity is applied on a part of surface of an insulator, such that first, in a dry environment, during normal operation of the insulator, the leakage current is basically the same as the case in which no conductive coating is adopted and no obvious leakage current occurs, and secondly, the part of surface being applied with the conductive coating has changed the surface resistivity distribution of a conventional insulator, such that the value of the leakage current at the surface of the insulator is increased in an icing climate condition, thereby achieving the effects of increasing the surface temperature of the insulator and preventing ice formation. Therefore, by applying the conductive coating having a specific resistivity at a part of surface of the insulator, the value of the leakage current on the surface of the insulator may change according to the climate environment: in a dry environment, no current or no obvious current occurs, and the insulator is equivalent to an open state of a switch; and in an icing environment, a current occurs, and the insulator is equivalent to a closed state of a switch, so as to form an insulator having a self-turn-off effect.

Furthermore, according to the present disclosure, as in a dry environment, the nonconductive coating region on the surface of the insulator leaves no continuous conductive channel between the upper and lower fittings, and the insulator keeps working in a case that the leakage current is relatively small, so the power energy consumption is low, and no obvious thermal effect occurs to accelerate the thermal aging of the silicone rubber. In an environment of a high humidity or rainfall and a low temperature, as the conductive coating region of the insulator has a good low temperature hydrophobicity, the insulating strength of the nonconductive coating region of the insulator decreases accordingly, and a corona and a local small arc discharge occur at the nonconductive coating region to increase the surface temperature, so as to prevent the ice layer from forming on the surface of the insulator.

Compared with the prior art, in the present disclosure, by applying a low-resistance coating on a part of surface of the insulator, in an icing, dewing and other high-humidity environment, the surface of the insulator may be dried through the heat generated from the surface discharge, so as to reduce the surface electric conductivity and prevent a pollution flashover accident, thereby facilitating the safe operation of the insulator of the power transmission line. Meanwhile, the insulator has a very low leakage current in a dry environment, so the power consumption level is reduced. Also, the technique of applying the surface coating according to the present disclosure is very simple, so the present disclosure has a very high cost efficiency and application value.

In a preferred embodiment, by adding heating filler carbon black in the surface coating, the surface coating can keep the hydrophobicity in a weather condition of low-temperature freezing rain. After the surface coating is applied in the insulator, the heating performance is good and the attachment and freezing of the supercooled water drops on the surface of the insulator can be effectively reduced, so as to facilitate the safe operation of the insulator of the power transmission line. The experimental results show that after the present disclosure is applied, the formation of the ice layer on the surface of the insulator and the formation of the icicles at the edges of the sheds can be effectively prevented.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

The present disclosure is illustrated in detail below with reference to the accompanying drawings and the specific embodiments.

Figure 1:
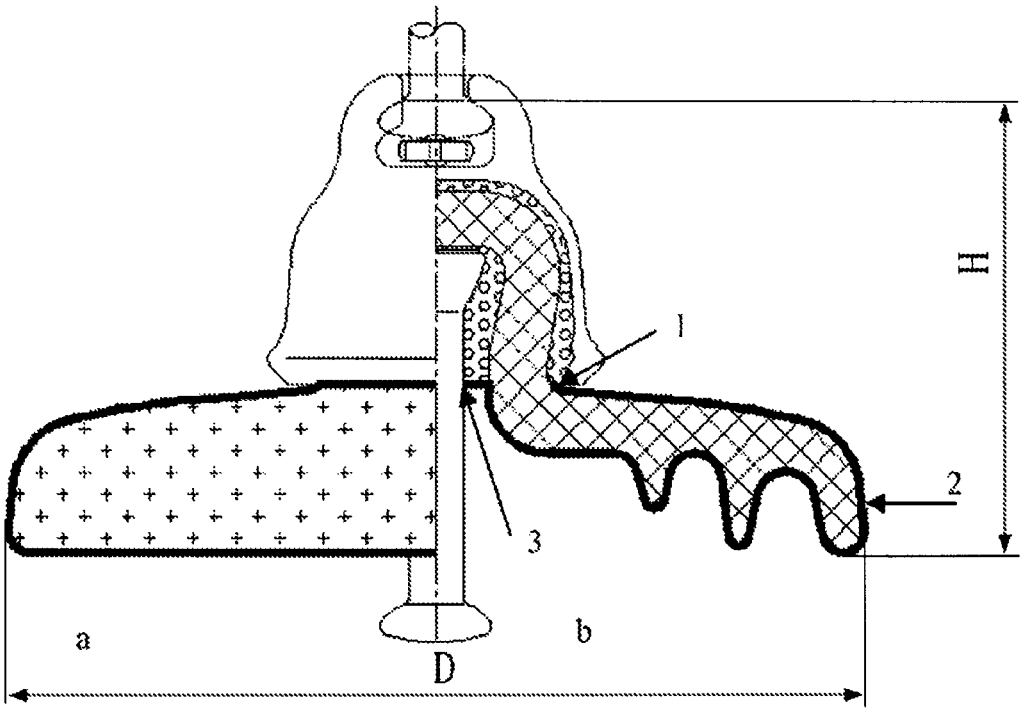
FIG. 1 is a semi-sectional view of an insulator according to an embodiment of the present disclosure.

In an embodiment, the insulator includes an insulating surface. A part of the insulating surface is applied with a conductive coating having a specific resistivity. Referring to FIG. 1, for an insulator according to an embodiment, a central line is taken as a border, the left half a of the central line is an outer surface view of the insulator, and the right half b is a sectional view of the insulator. The conductive coating region having the specific resistivity of the insulating surface is the surface between point 2 and point 3 in FIG. 1. The volume resistivity of the conductive coating having the specific resistivity is preferably $10^5$ ohm-centimeters to form a low-temperature hydrophobic surface. The coating thickness is preferably between 0.3 mm and 0.4 mm. The region between point 1 and point 2 in FIG. 1 is not applied with the conductive coating, which is a nonconductive coating region. The conductive coating region having the specific resistivity and the nonconductive coating region are configured that: in a dry environment, no continuous conductive channel exists between fittings at end portions of the insulator (for the insulator as shown in FIG. 1, between the upper and lower fittings) . Also, due to the leakage current on the insulating surface caused by the conductive coating having the specific resistivity, in an icing climate condition, the insulating surface may reach an ice-proof temperature. The insulator as shown in FIG. 1 and the conductive coating region, the coating thickness, and the volume resistivity are only exemplary, and it should be understood that as long as the applied conductive coating meets the above configuration condition, the objective of the present disclosure can be achieved.

Typically, a the disk-shaped suspension-type insulator is adopted. The position of applying the conductive coating is preferably selected from regions other than regions adjacent to the fittings on the insulator.

As shown in FIG. 1, in the preferred embodiment, the conductive coating is applied at a lower surface of the insulator, while the upper surface blank region that is not applied with the conductive coating extends to radial edges of the insulator.

In some embodiments, a volume resistivity of the conductive coating is preferably between $10^3$ ohm-centimeters and $10^5$ ohm-centimeters.

In some embodiments, the coating thickness of the conductive coating is preferably between 0.2 mm and 0.6 mm, and more preferably the coating thickness of the conductive coating is between 0.3 mm and 0.4 mm.

In one embodiment, the base material of the conductive coating is conductive silicone rubber. In particular, the volume resistivity of the silicone rubber is $10^5$ ohm-centimeters. The coating thickness of the surface coating is about between 0.3 mm and 0.4 mm.

In some embodiments, the nonconductive coating region is applied with RTV silicone rubber or PRTV silicone rubber.

In some embodiments, the coating silicone rubber is preferably added with carbon black, and particularly 10%-30% carbon black by weight. The applied surface coating can keep the hydrophobicity in a weather condition of low-temperature freezing-rain, so that the heating performance of the insulator is good, so as to effectively reduce the attachment and freezing of the supercooled water drops on the surface of the insulator.

The type of the insulator is not limited. For example, the insulator may be a ceramic suspension-type insulator, and may also be a glass suspension-type insulator.

Figure 2:
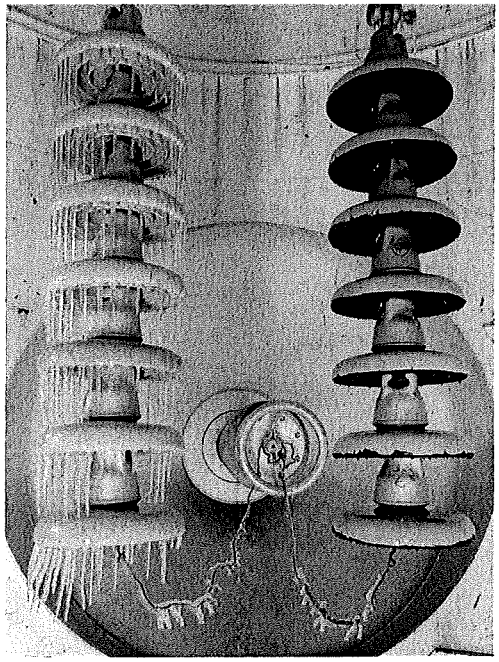
FIG. 2 shows the comparison between the insulator according to the present disclosure and a conventional insulator after the icing test for 2 hours.

Here, a power transmission line apparatus is also described, which includes at least one of any insulators according to the various embodiments above. The power transmission line apparatus preferably includes an insulator string formed of a plurality of insulators connected to a power transmission line, as shown in FIG. 2.

Contrast Test of Ice-proof Effect of A 110-kV Insulator String:

(1) Test Object

The structural parameters of the insulator used in the test are shown in Table 1.

Table 1 Structural Parameters of Insulator xp3-16

| Structural Height cm | Disk Diameter cm | Creepage Distance cm |
|---|---|---|
| 14.6 | 28 | 33.5 |

The insulator string in the experimental group is formed of 7 insulators with the lower surface applied with a conductive coating;

The insulator string in the control group is formed of 7 insulators that are not applied with a conductive coating.

The two strings are suspended in a climate chamber in parallel. The insulator string without the conductive coating is on the left, while the insulator string with the bottom surface applied with the conductive coating according to the embodiment of the present disclosure is on the right.

(2) Test Condition

The test spraying water uses the tap water after the filtering and deionization processing, which is mixed with the tap water in different proportions to adjust the conductivity to 100 μs/cm. The icing water is cooled to about zero degree by using a refrigerator, then enters the climate test box after being compressed by a water pump, and is sprayed by the nozzle. The rotating cylinder method is adopted to measure that the icing rate is 3 mm/h. The control parameter of the icing test is as shown in Table 2.

TABLE 2

Icing Test Control Parameter

| Parameter | Value |
|---|---|
| Temperature | −8° C. |
| Average drop size | 200 μm |
| Icing water conductivity (20 degrees) | 100 μs/cm |
| Spraying direction | 45° obliquely downward |
| Wind speed | 0 |

The icing test voltage is an alternating current, 50 Hz, effective value being 63.5 kV, and the icing test lasts for three hours.

The climate chamber has two rows of nozzles on the left and right, two strings of insulators may be suspended in parallel in the middle, and the icing conditions for the two strings of insulators are the same.

(3) Test Result

Figure 3:
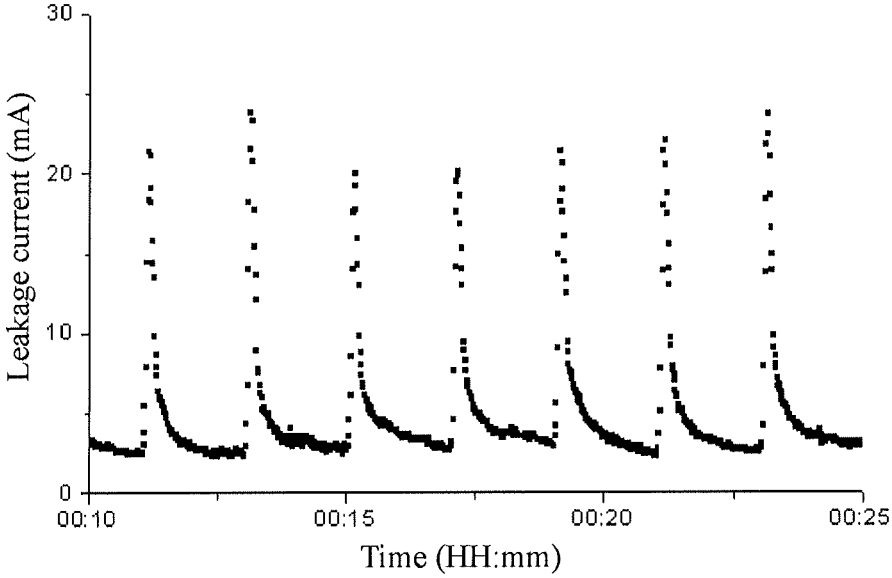
FIG. 3 shows a waveform of a leakage current in an icing period of an insulator string according to an embodiment of the present disclosure.

After the icing, the icing forms of the two strings of insulators are as shown in FIG. 2. The values of the icing leakage current are as shown in FIG. 3. It can be seen from the contrast that no ice layers and icicles are formed on the surface of the insulator string according to the embodiments of the present disclosure. In the equivalent conditions, a condensed continuous ice layer is formed on the surface of the insulator without the coating. The icicles at the edges bridge the whole string of insulators. The test result indicates that the present disclosure can effectively prevent the ice from forming on the surface of the insulator. Meanwhile, in an ice-free environment, the insulator has a very low leakage current and a low power consumption level.

The above contents are further detailed illustration of the present disclosure with reference to the specific preferred embodiments. It should not be regarded that the specific implementation of the present disclosure is limited to these illustrations only. Several simple derivations or replacements can be made by persons of ordinary skill in the technical field of the present disclosure without departing from the concept of the present disclosure, and the derivations or replacements shall all be construed as falling within the protection scope of the present disclosure.

What is claimed is:

1. An insulator, comprising an upper disk, the upper disk comprising an insulating surface, wherein an exposed part of the insulating surface is applied with a conductive coating having a specific resistivity, wherein a main material of the conductive coating is conductive silicone rubber, the conductive coating being applied at a lower surface of the upper disk, and a conductive coating region having the specific resistivity and a nonconductive coating region are configured such that in a dry environment, no continuous conductive channel exists between fittings at end portions of the insulator, and due to a leakage current caused by the conductive coating having the specific resistivity on the insulating surface in an icing climate condition, the insulating surface reaches an ice-resisting temperature, the insulator is a disk shaped suspension-type insulator, and a position of applying the conductive coating is selected from regions other than regions adjacent to an upper fitting of the insulator; the nonconductive coating region is applied with room temperature vulcanized (RTV) silicone rubber or permanent RTV (PRTV) silicone rubber.

2. The insulator according to claim 1, wherein a volume resistivity of the conductive coating is between $10^3$ ohm-centimeters and $10^5$ ohm-centimeters.

3. The insulator according to claim 1, wherein a coating thickness of the conductive coating is between 0.2 mm and 0.6 mm.

4. The insulator according to claim 1, wherein the silicone rubber is added with 10%-30% carbon black by weight.

5. The insulator according to claim 1, wherein the silicone rubber is added with 10%-30% carbon black by weight.

6. The insulator according to claim 1, wherein the insulator is a ceramic suspension-type insulator or a glass suspension-type insulator.

7. A power transmission line apparatus, comprising at least one of the insulator according to claim 1.

8. The insulator according to claim 2, wherein a coating thickness of the conductive coating is between 0.2 mm and 0.6 mm.

* * * * *